US008042468B2

(12) United States Patent
Kündgen et al.

(10) Patent No.: US 8,042,468 B2
(45) Date of Patent: Oct. 25, 2011

(54) DEVICE FOR MOUNTING A PRINTING PLATE ON A PLATE CYLINDER OF A PRINTING PRESS, PRINTING UNIT HAVING THE DEVICE AND PRINTING PRESS HAVING THE PRINTING UNIT

(75) Inventors: Rolf Kündgen, Bad Schönborn (DE); Gerd Merkel, Dielheim (DE); Rudi Stellberger, Kornau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 467 days.

(21) Appl. No.: 12/243,174

(22) Filed: Oct. 1, 2008

(65) Prior Publication Data

US 2009/0084280 A1 Apr. 2, 2009

(30) Foreign Application Priority Data

Oct. 1, 2007 (DE) ..... 10 2007 047 085

(51) Int. Cl.
*B41F 21/00* (2006.01)

(52) U.S. Cl. ..... 101/415.1; 101/383

(58) Field of Classification Search ..... 101/382.1, 101/383, 415.1

See application file for complete search history.

(56) References Cited

U.S. PATENT DOCUMENTS

| | | | | |
|---|---|---|---|---|
| 3,727,551 | A * | 4/1973 | Kostas et al. | 101/415.1 |
| 3,869,985 | A * | 3/1975 | Steinmetz et al. | 101/415.1 |
| 4,157,067 | A * | 6/1979 | Datwyler | 101/415.1 |
| 4,493,258 | A * | 1/1985 | Wallschlaeger et al. | 101/415.1 |
| 5,088,410 | A | 2/1992 | Murakami | |
| 5,181,469 | A * | 1/1993 | Merkel et al. | 101/415.1 |
| 5,325,778 | A * | 7/1994 | Hartung et al. | 101/415.1 |
| 5,413,042 | A * | 5/1995 | Weiss et al. | 101/415.1 |
| 5,488,904 | A * | 2/1996 | Kleinschmidt et al. | 101/415.1 |
| 5,495,804 | A | 3/1996 | Stellberger et al. | |

FOREIGN PATENT DOCUMENTS

| | | |
|---|---|---|
| CH | 515 124 | 11/1971 |
| DE | 94 01 760 U1 | 3/1994 |
| DE | 691 05 036 T2 | 4/1995 |
| GB | 1 300 575 | 12/1972 |

OTHER PUBLICATIONS

German Patent and Trademark Office Search Report, dated Mar. 27, 2008.

* cited by examiner

*Primary Examiner* — Ren Yan

(74) *Attorney, Agent, or Firm* — Laurence A. Greenberg; Werner H. Stemer; Ralph E. Locher

(57) ABSTRACT

A device for clamping and tensioning an edge of a printing plate on a plate cylinder of a printing press includes a single actuating shaft for releasing clamping and tensioning forces. The actuating shaft has a control cam for releasing the tensioning forces and a control roller for releasing the clamping forces. A printing unit having the device and a printing press having the printing unit are also provided.

5 Claims, 4 Drawing Sheets

DEVICE FOR MOUNTING A PRINTING PLATE ON A PLATE CYLINDER OF A PRINTING PRESS, PRINTING UNIT HAVING THE DEVICE AND PRINTING PRESS HAVING THE PRINTING UNIT

CROSS-REFERENCE TO RELATED APPLICATION

This application claims the priority, under 35 U.S.C. §119, of German Patent Application DE 10 2007 047 085.3, filed Oct. 1, 2008; the prior application is herewith incorporated by reference in its entirety.

BACKGROUND OF THE INVENTION

Field of the Invention

The invention relates to a device for clamping and tensioning a printing plate, in particular a trailing edge of a printing plate, on a plate cylinder of a printing press. The invention also relates to a printing unit having the device and a printing press having the printing unit.

German Utility Model G 94 01 760 U1, corresponding to U.S. Pat. No. 5,495,804, discloses a device for clamping and tensioning a printing plate on a plate cylinder of a printing press. A pivotable cam shaft is provided which causes the printing plate tension and the clamping action to be released. In order to release the tensioning of the printing plate, a clamping bar is displaced by a cam of the cam shaft against the force of a spring. In order to release the clamping force, a clamping flap is pivoted by a second cam of the cam shaft against the force of a further spring.

SUMMARY OF THE INVENTION

It is accordingly an object of the invention to provide a device for mounting a printing plate on a plate cylinder of a printing press, a printing unit having the device and a printing press having the printing unit, which overcome the hereinafore-mentioned disadvantages of the heretofore-known devices of this general type and which provide an alternative printing-plate clamping and tensioning device that is suitable for respectively providing and releasing high clamping forces.

With the foregoing and other objects in view, there is provided, in accordance with the invention, a device for clamping and tensioning an edge of a printing plate on a plate cylinder of a printing press. The device comprises a single actuating shaft for releasing clamping and tensioning forces. The actuating shaft has a control cam for releasing the tensioning forces, and a control roller for releasing the clamping forces.

In accordance with another feature of the invention, the control roller is disposed in operative engagement with a toggle lever mechanism, by a pull rod.

The provision of the toggle lever joint for generating the clamping force is of particular advantage to the invention. Due to this provision, low spring forces can generate high clamping forces.

In accordance with a further feature of the invention, the toggle lever mechanism is provided for actuating a clamping flap.

In accordance with an added feature of the invention, the control cam for releasing the tensioning forces is in cooperative engagement with a control roller of a holder for the clamping and tensioning device.

In accordance with an additional feature of the invention, the holder is pivotably supported.

A further advantage of the invention is apparent from the capability of generating the tensioning force of the printing plate by a pivoting movement of the plate clamping and tensioning device. This capability prevents the device from becoming jammed during the clamping process.

With the objects of the invention in view, there is also provided a printing unit, comprising the clamping and tensioning device according to the invention.

With the objects of the invention in view, there is concomitantly provided a sheet-fed rotary printing press, comprising the printing unit according to the invention.

Other features which are considered as characteristic for the invention are set forth in the appended claims.

Although the invention is illustrated and described herein as embodied in a device for mounting a printing plate on a plate cylinder of a printing press, a printing unit having the device and a printing press having the printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
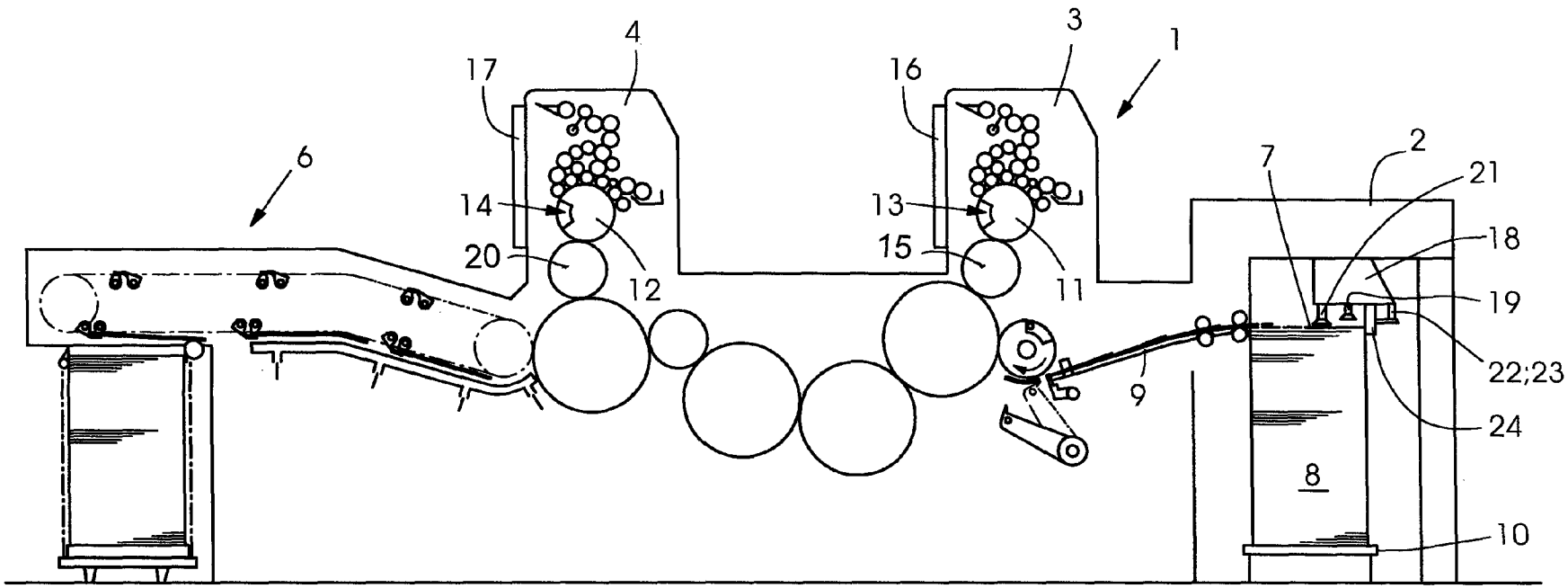
FIG. 1 is a diagrammatic, longitudinal-sectional view of a printing press.

Referring now to the figures of the drawings in detail and first, particularly, to FIG. 1 thereof, there is seen a machine for processing sheets 7, such as a printing press 1, including a feeder 2, at least one printing unit 3 and 4, and a delivery 6. The sheets 7 are taken from a sheet pile or stack 8 and are fed to the printing units 3 and 4 over a feed table 9 as individual sheets or as a shingled or imbricated stream of sheets. As is known in the prior art, each of the printing units 3 and 4 includes a plate cylinder 11, 12 and a blanket cylinder 15, 20 cooperating with the respective plate cylinder 11,12. Each plate cylinder 11, 12 includes a respective clamping and tensioning device 13, 14 for mounting flexible printing plates thereon. Moreover, a respective device 16, 17 for semiautomatically or fully automatically changing printing plates is associated with each plate cylinder 11, 12.

The pile or stack 8 of the sheets 7 lies on a controllably liftable stack plate 10. Sheets 7 are removed from the top of the sheet pile or stack 8 by a suction head 18 which includes, among other elements, a number of lifting and dragging suckers 19, 21 for separating the sheets 7. Moreover, blowers 22 are provided for loosening the upper sheets, and sensing elements 23 are provided for initiating the lifting of the pile or stack 8. A number of lateral and rear stops 24 are provided to align the pile or stack 8 of sheets, in particular the top sheets 7 in the pile or stack 8.

Figure 2:
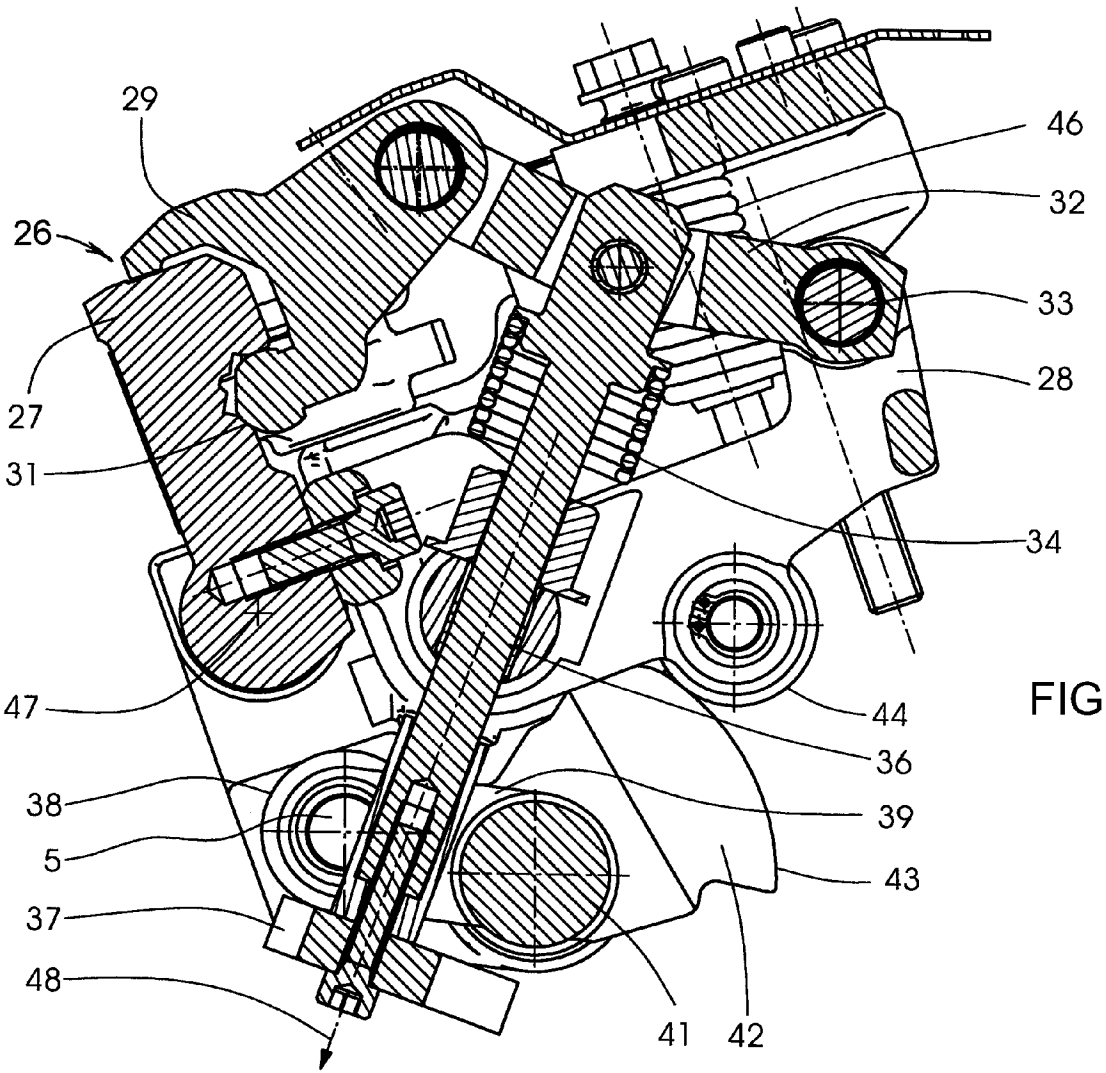
FIG. 2 is an enlarged, cross-sectional view of a printing plate clamping and tensioning device of FIG. 1.
Figure 3:
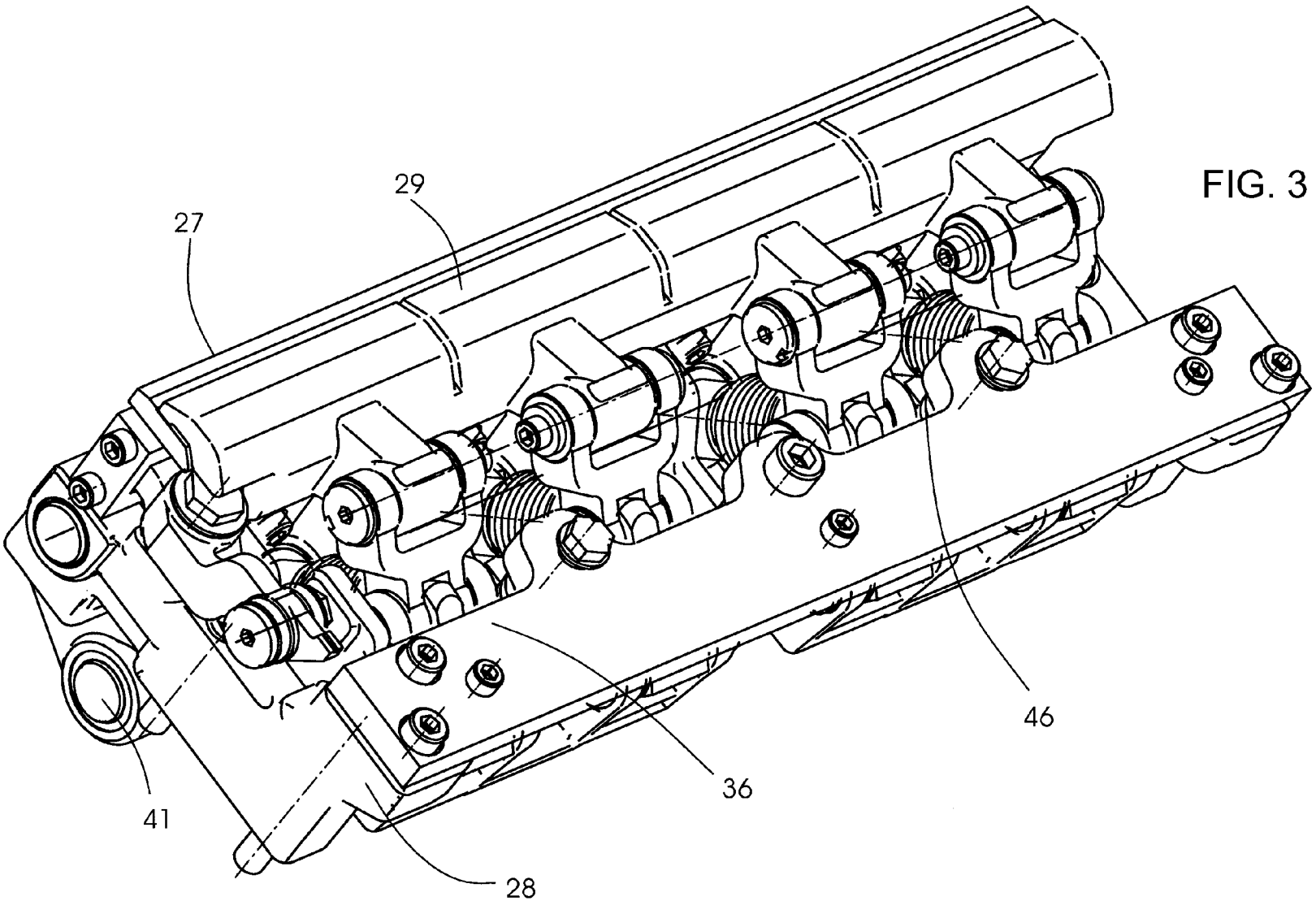
FIG. 3 is a top, end and side perspective view of the printing plate clamping and tensioning device of FIG. 2.
Figure 4:
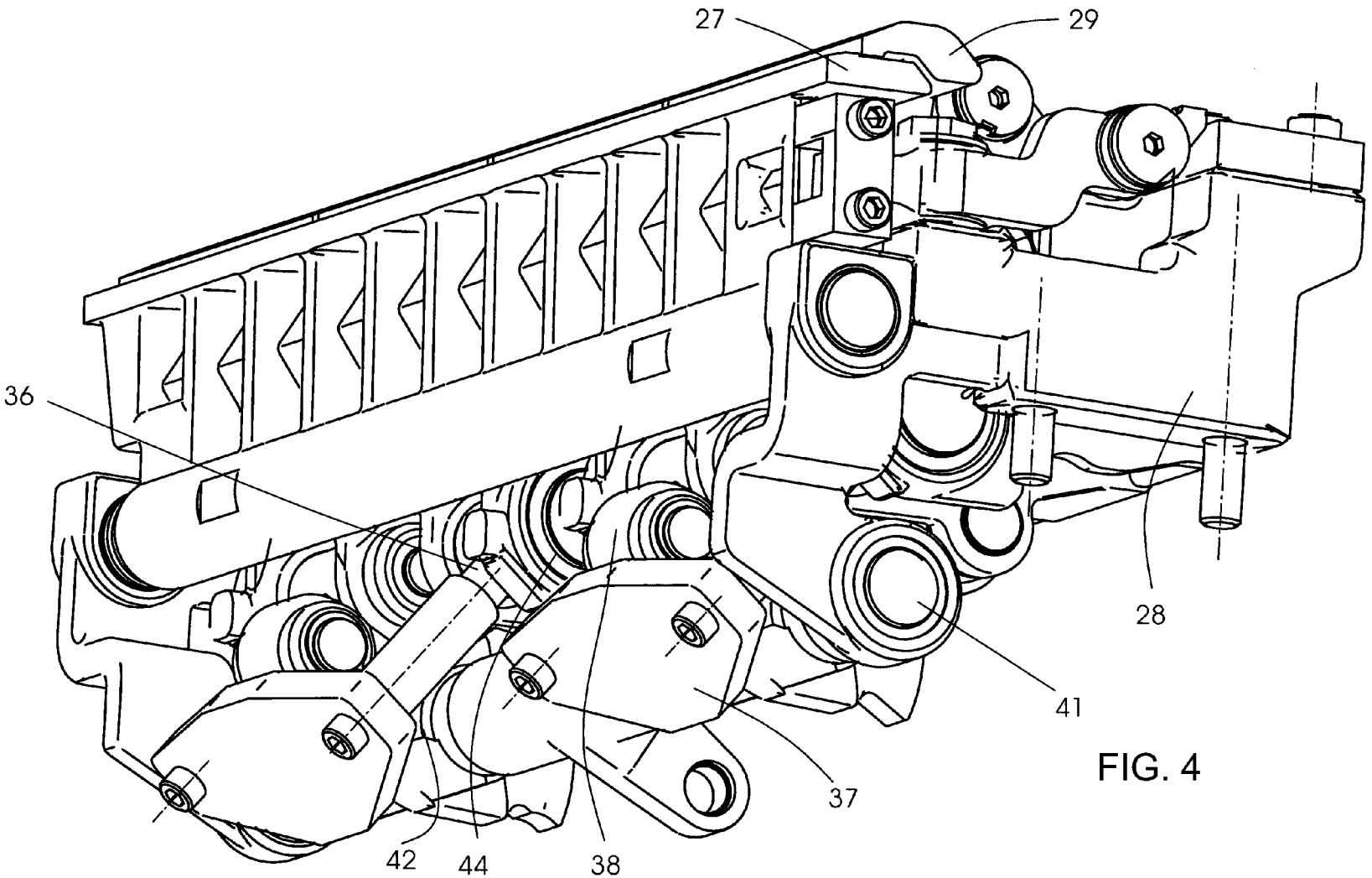
FIG. 4 is a front, top and side perspective view of the printing plate clamping and tensioning device of FIGS. 2 and 3.

As is seen in FIGS. 2, 3 and 4, the clamping and tensioning device 13 includes a device for clamping a non-illustrated leading edge of a printing plate and a device 26 for clamping and tensioning a trailing edge of the printing plate. The device 26 for clamping and tensioning the trailing edge of the plate is basically formed of a lower clamping bar 27 which is attached to a support or holder 28. An upper clamping flap 29 cooperating with the clamping bar 27 is supported so as to be capable of pivoting on a mount 31 of the clamping bar 27. The clamping flap 29 is pivotable about a bearing point of the mount 31 by a two-armed toggle lever mechanism 32, which is articulated at a bearing point 33 of the support or holder 28. The toggle lever mechanism 32 is actuated by a pre-tensioned compression spring 34, which is supported on the support or holder 28 and pushes the toggle lever mechanism 32 into a clamping position. A pull rod 36 also acts on the toggle lever mechanism 32 to pull the toggle lever mechanism 32 against the force of the springs 34 into a receiving or take-up position for receiving the printing plate.

A switching plate 37, which is in operative engagement with a first control roller 38, is carried on one end of the pull rod 36. The control roller 38 is disposed on an actuating shaft 41 through the use of a roller lever 39. Moreover, the actuating shaft 41 has a cam 42 with a control contour 43 which is in operative engagement with a second control roller 44. The control roller 44 is disposed on the support 28. A spring 46 is supported on the plate cylinder 11 and pushes the support or holder 28 about a pivot axis 47 into a clamping position for clamping the printing plate.

The actuating shaft 41 is pivoted in a counter-clockwise direction to release the tensioning of the printing plate. During the pivoting process, the control roller 44 rolls on the control contour 43 of the cam 42 to pivot the support or holder 28 about the pivot axis 47 in a counter-clockwise direction from a tensioning position into a receiving position. As the actuating shaft 41 pivots farther in the counter-clockwise direction, the control roller 38 subsequently comes into contact with the switching plate 37 and causes the pull rod 36 to push the toggle lever 32 in the direction of an arrow 48. As a result thereof, the clamping flap 29 opens against the force of the spring 34, and releases the trailing edge of the printing plate.

The invention claimed is:

1. A device for clamping and tensioning an edge of a printing plate on a plate cylinder of a printing press, the device comprising:

a toggle lever mechanism for generating clamping forces on the edge of the printing plate;

a device for generating tensioning forces on said toggle lever mechanism;

a single actuating shaft for releasing the clamping and tensioning forces;

said actuating shaft having a control cam for releasing the tensioning forces and a control roller for releasing the clamping forces;

a pull rod placing said control roller in operative engagement with said toggle lever mechanism; and a clamping flap actuated by said toggle lever mechanism.

2. The device according to claim 1, which further comprises a holder having a control roller, said control cam being in cooperative engagement with said control roller for releasing the tensioning forces.

3. The device according to claim 2, wherein said holder is pivotably supported.

4. A printing unit, comprising the clamping and tensioning device according to claim 1.

5. A sheet-fed rotary printing press, comprising a printing unit having the clamping and tensioning device according to claim 1.

* * * * *